US010974127B2

(12) United States Patent
Locatelli et al.

(10) Patent No.: US 10,974,127 B2
(45) Date of Patent: Apr. 13, 2021

(54) SNOWSHOES

(71) Applicant: Robert Erwin Behrens, Ayas (IT)

(72) Inventors: Marco Locatelli, Milan (IT); Robert Erwin Behrens, Ayas (IT)

(73) Assignee: Robert Erwin Behrens, Frazione Crest (IT)

( * ) Notice: Subject to any disclaimer, the term of this patent is extended or adjusted under 35 U.S.C. 154(b) by 45 days.

(21) Appl. No.: 15/519,172

(22) PCT Filed: Oct. 15, 2015

(86) PCT No.: PCT/IB2015/057911
§ 371 (c)(1),
(2) Date: Apr. 14, 2017

(87) PCT Pub. No.: WO2016/059581
PCT Pub. Date: Apr. 21, 2016

(65) Prior Publication Data

US 2017/0225061 A1 Aug. 10, 2017

(30) Foreign Application Priority Data

Oct. 15, 2014 (IT) ..... TO2014A000841

(51) Int. Cl.
*A63C 13/00* (2006.01)
*A43C 15/06* (2006.01)
(Continued)

(52) U.S. Cl.
CPC ..... *A63C 13/005* (2013.01); *A43C 15/063* (2013.01); *A43C 15/065* (2013.01);
(Continued)

(58) Field of Classification Search
CPC ... A63C 13/001; A63C 13/003; A63C 13/006; A63C 13/008; A63C 13/005;
(Continued)

(56) References Cited

U.S. PATENT DOCUMENTS 288,653 A * 11/1883 Morgan ..... A43C 15/06 36/7.6
637,221 A * 11/1899 Feher ..... A43C 15/14 36/61
(Continued)

FOREIGN PATENT DOCUMENTS

EP 0613704 B1 7/1998
WO 9627414 A1 9/1996
(Continued)

*Primary Examiner* — Alissa J Tompkins
*Assistant Examiner* — Dakota Marin
(74) *Attorney, Agent, or Firm* — Thomas Horstemeyer, LLP

(57) ABSTRACT

Snowshoes are provided which include a footwear supporting plate, a front binding device and a rear binding device. The plate has a lattice-like, essentially flat configuration formed by a plurality of hollow prismatic structures partially superimposed on one another. The main axis (x) of each hollow prismatic structure may be inclined by an angle (α) between 200 and 70° relative to a middle plane of the plate, in such a manner that lower edges of the hollow prismatic structures form sharp edges which allow the plate to grip snow and inner surfaces of the hollow prismatic structures offer high resistance to penetration into snow allowing for the distribution of weight of a user over a wide contact surface, thereby ensuring good floatability.

10 Claims, 6 Drawing Sheets

(51) Int. Cl.
*A43C 15/14* (2006.01)
*A43C 15/09* (2006.01)
*A43C 15/10* (2006.01)

(52) U.S. Cl.
CPC ..... *A43C 15/066* (2013.01); *A43C 15/068* (2013.01); *A43C 15/09* (2013.01); *A43C 15/10* (2013.01); *A43C 15/14* (2013.01); *A63C 13/001* (2013.01); *A63C 13/003* (2013.01); *A63C 13/006* (2013.01); *A63C 13/008* (2013.01)

(58) Field of Classification Search
CPC ... A43C 15/068; A43C 15/063; A43C 15/065; A43C 15/066; A43C 15/09; A43C 15/10; A43C 15/14
USPC ..... 36/7.7, 7.6, 134, 59 C, 122, 123, 124, 36/125, 116
See application file for complete search history.

(56) References Cited

U.S. PATENT DOCUMENTS 935,998 A * 10/1909 Kossier ..... A43C 15/066 36/64
975,379 A * 11/1910 Ashbaugh ..... A43C 15/063 36/7.7
1,098,232 A * 5/1914 Decius ..... A43C 15/06 36/7.6
1,493,856 A * 5/1924 Golden ..... A43C 15/162 36/59 R
1,837,730 A * 12/1931 Smith ..... A43C 15/06 36/7.6
1,871,964 A * 8/1932 Driscoll ..... A43B 5/18 36/64
2,316,062 A * 4/1943 Gingo ..... A43C 15/063 36/64
2,395,270 A * 2/1946 Hastings, Jr. ..... A43B 5/18 36/7.7
2,588,919 A * 3/1952 Gredell ..... A43C 15/063 36/7.7
2,608,008 A * 8/1952 Scott ..... A43C 15/063 36/7.7
2,618,869 A * 11/1952 Wincentsen ..... A63C 13/005 36/125
3,018,571 A * 1/1962 Doherty ..... A43B 13/18 36/59 C
3,600,829 A * 8/1971 Violette ..... A63C 13/001 36/124
3,638,333 A * 2/1972 Sprandel ..... A63C 13/001 36/125
3,786,989 A 1/1974 Haynes
4,299,037 A * 11/1981 Carey ..... A43C 15/06 36/62
4,641,438 A * 2/1987 Laird ..... A43B 13/223 36/32 R
5,014,450 A 5/1991 McGrath
5,077,916 A * 1/1992 Beneteau ..... A43B 5/001 36/128
5,485,687 A * 1/1996 Rohde ..... A43C 15/02 36/59 R
5,540,002 A * 7/1996 Liautaud ..... A63C 13/001 36/122
5,713,140 A * 2/1998 Baggenstoss ..... A43B 13/184 36/25 R
5,794,367 A * 8/1998 Carroll ..... A43C 15/162 36/127
5,881,477 A * 3/1999 Watson ..... A63C 13/001 36/122
5,901,471 A * 5/1999 Warner ..... A43C 15/068 36/124
6,185,846 B1 2/2001 Neidhardt, Jr.
6,742,286 B2 * 6/2004 Giovale ..... A43C 15/061 36/62
6,772,542 B2 * 8/2004 Jacobson ..... A63C 7/06 280/600
7,152,344 B2 * 12/2006 Yoo ..... A43C 15/063 36/61
8,595,958 B2 * 12/2013 Chartrand ..... A43C 15/068 36/124
2003/0037461 A1 * 2/2003 Petzl ..... A43C 15/068 36/7.6
2004/0016145 A1 * 1/2004 Skrivan ..... A43C 15/068 36/7.6
2004/0111922 A1 * 6/2004 Fusco ..... A43B 13/12 36/59 R
2011/0283567 A1 * 11/2011 Yin ..... A43B 3/0078 36/30 R

FOREIGN PATENT DOCUMENTS

WO 2014027893 A1 2/2014
WO 2014071232 A1 5/2014
WO 9607457 A1 4/2017

* cited by examiner

SNOWSHOES

CROSS-REFERENCE TO RELATED APPLICATIONS

This application is a National Phase Application of PCT International Application No. PCT/IB2015/057911, International Filing Date, Oct. 15, 2015 claiming priority to Italian Patent Application No. TO2014A000841 filed Oct. 15, 2014, each of which is hereby incorporated by reference in its entirety.

FIELD OF THE INVENTION

The present invention relates to snowshoes as described and claimed herein.

BACKGROUND OF THE INVENTION

A snowshoe of this type is known from EP 0 613 704.

The snowshoes are devices typically used for hiking activities in snowy environments to enable to move easily by foot on fresh snow. The snowshoes typically comprise a plate, which may be made of plastic material, of metal, of fabric or even of a combination of these materials, and binding means for biding the plate to the shoe of the user, typically a winter hiking boot. The plate has a length and a width larger than those of the sole of the shoe of the user, so as to provide a contact surface with the ground (or, better, with the snow layer) wider than that provided by the shoe sole. The binding means may include from simple belts to more sophisticated automatic binding devices. Moreover, a hinge coupling is usually provided between the binding means and the plate to allow, permanently or only temporarily, free movement of the user heel, i.e. to allow the foot sole to move independently of the plate, which plate remains therefore with its plane approximately parallel to the ground during walking. A modem snowshoe is disclosed for example by WO2014/027893.

Most of the snowshoes currently known are mainly designed to provide floatation in powder snow on the flat and are therefore not very suitable for snowy uneven grounds, in particular snowy slopes with a gradient starting from 20 degrees. Moreover, most of the snowshoes currently known have large sizes and are therefore bulky and not easy to transport when not used, for example during a descent on ski or snowboard.

So-called "compact" snowshoes, such as for example the one disclosed in U.S. Pat. No. 6,185,846, were conceived in the past and are characterized in that they have compact sizes in order to make it easier for the user to walk on mixed ground and to make it easier to transport them when not being used, and in that they have a fixed heelpiece and hence keep the foot permanently fixed to the plate. These snowshoes have, however, plate structures like those of the traditional snowshoes and offer lower characteristics in terms of floatation in powder snow and grip on packed snow or ice, and on steep slopes.

Products like the one disclosed in WO2014/071232 are also available on the market and basically consist in plates which, once suitably coupled to mountain crampons, allow to in-crease floatation in powder snow and thus make ascent and descent on snowy slopes easier. However, these known products have a number of disadvantages: they are heavy, they do not ensure high grip on powder snow and, furthermore, they tend both to form blocks of pressed snow that remain stuck to the bottom face of the plate and to retain on the upper face of the plate the snow that inevitably slides thereon, thus making it even more difficult for the user to walk.

It is an object of the present invention to provide an improved snowshoe with respect to the above-discussed prior art.

SUMMARY OF THE INVENTION

More specifically, it is an object of the present invention to provide a snowshoe which allows the user to move easily on uneven snowy terrains, in particular on snowy slopes, which offers high grip both on powder snow and on packed snow, which ensures good floatability in powder snow, which avoids, or at least minimize, accumulation of snow both under the plate and above the plate, which ensures good maneuverability, which is lightweight and compact so that it can be easily transported when it is not used (for example during a descent on ski or snowboard).

These and other objects are fully achieved according to the invention by virtue of a snowshoe having the features described and claimed herein.

In short, the invention is based on the idea of providing a snowshoe whose plate has a lattice-like configuration, extending preferably in a plane, which is formed by a plurality of hollow prismatic structures partially superimposed on one another, wherein the main axis of each of these structures is inclined with respect to a middle surface of the plate in such a manner that the projection of said axis on a longitudinal vertical plane, i.e. on a vertical plane directed along the longitudinal direction, or front-to-rear direction, of the plate forms an angle comprised between 20° and 70° with a direction normal to the middle surface of the plate.

By virtue of such a configuration of the plate, the lower edges of the hollow prismatic structures form sharp edges which enable the plate to get a grip on the snow, be it powder snow or packed snow. Moreover, by virtue of the inclined orientation of the hollow prismatic structures the inner surfaces of these structures offer a wide area on which the weight of the user is discharged and therefore ensure good floatability although the plate has a lattice-like configuration and is of compact sizes.

Preferably, said plurality of hollow prismatic structures comprises a first group of structures having an arched lower edge, particularly suitable for penetrating into powder snow, and a second group of structures having a cusped lower edge, particularly suitable for packed snow. In this case, the plate is preferably shaped such that it has rows of structures of the first group, i.e. with arched lower edges, alternate with rows of structures of the second group, i.e. with cusped lower edges.

The main axes of the hollow prismatic structures may have different inclinations in the various areas of the plate, in particular be inclined frontwards in the front part of the plate, so as to improve the grip of the snowshoe on the ground during climbing, and inclined rearwards in the rear part of the plate, so as to improve the grip of the snowshoe on the ground during descent.

Preferably, the plate is made as a single piece, for example of plastic material.

According to an embodiment, the snowshoe further comprises a front binding device and a rear binding device, which are both fixed to the plate, preferably at an adjustable distance from each other.

Preferably, each of said front and rear binding devices comprises a metal base element attached to the plate and a flexible binding member which is suitably connected to the respective base element and is shaped such that it restrains the toe and the heel of the shoe of the user, respectively.

Preferably, the snowshoe is provided with crampons to further improve walking on ice or mixed terrain (for example rock and snow). The crampons may be directly attached to the base elements of the front and rear binding devices or made in one piece with the front and rear binding devices. Alternatively, the crampons may be directly attached to the plate or made in one piece with the plate or with part of the plate.

Further features and advantages of the present invention will become more apparent from the following detailed description, given purely by way of non-limiting examples with reference to the attached drawings.

DETAILED DESCRIPTION

In the following description and claims, terms such as "front" and "rear", "upper" and "lower", "longitudinal" and "transverse", "vertical" and "horizontal" etc. are to be intended as referring to the condition in which the snowshoe is used by the user and rests on the ground on the flat. In particular, the term "longitudinal" is used here to indicate a direction parallel to the walking direction, while the term "transverse" is used here to indicate a direction perpendicular to the walking direction.

Figure 1A:
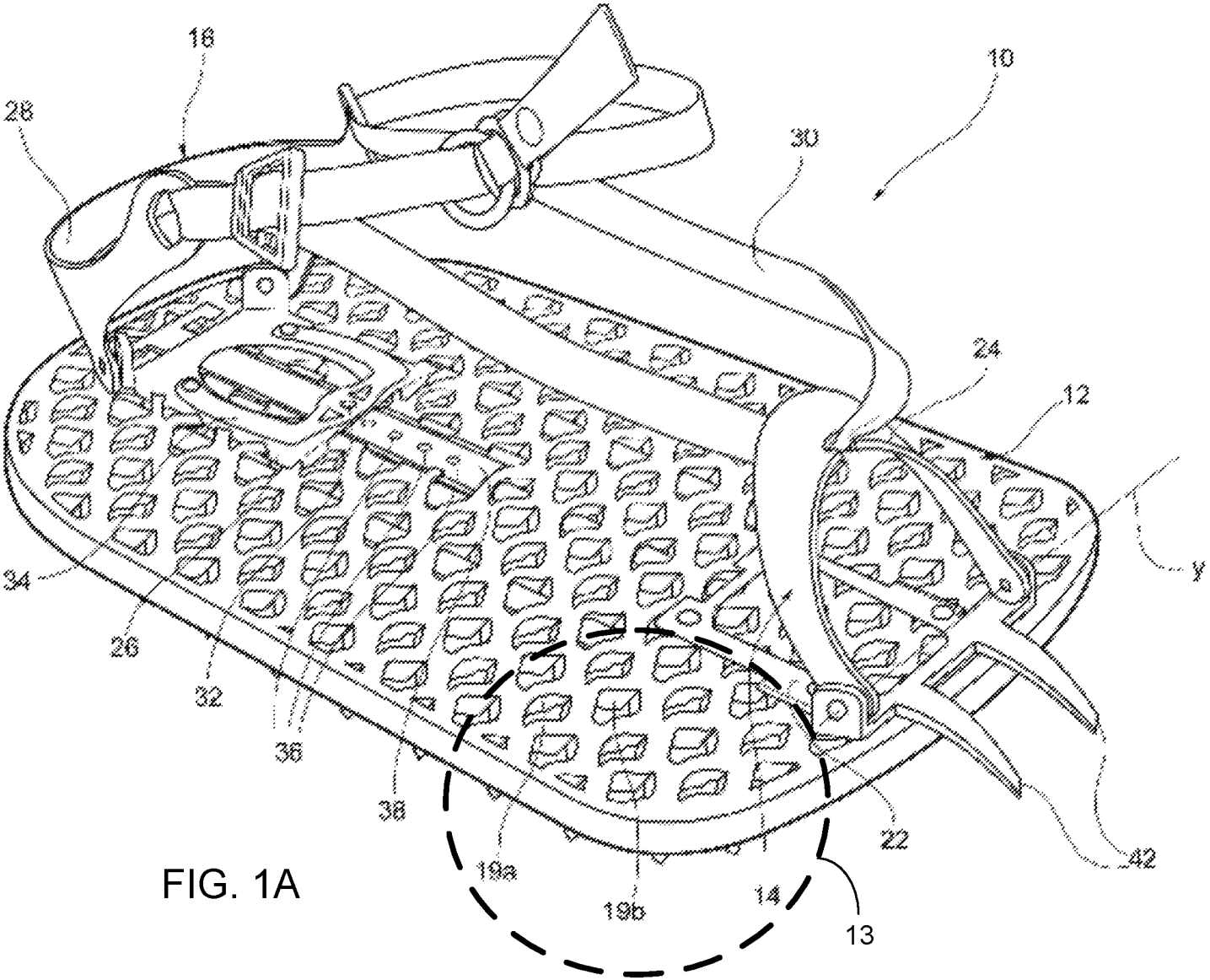
FIG. 1A is a perspective view of a snowshoe according to an embodiment of the present invention.
Figure 1B:
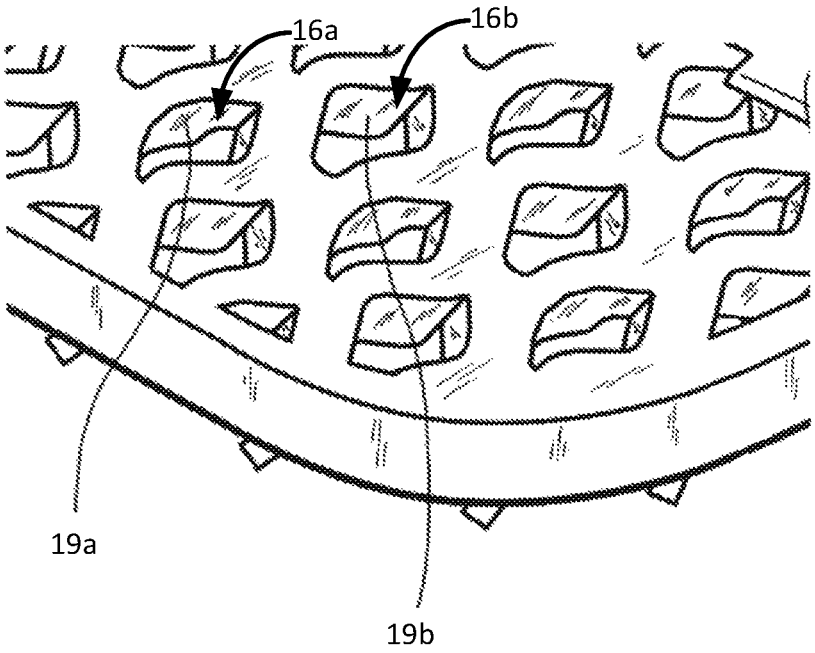
FIG. 1B is an enlarged perspective view of a portion of the snowshoe shown in FIG. 1A.

With reference first to FIG. 1A, a snowshoe according to an embodiment of the present invention is generally indicated 10. The snowshoe 10 basically comprises a plate 12, a front binding device 14 attached to a front portion of the plate 12 and a rear binding device 16 attached to a rear portion of the plate 12. The plate 12 has an elongated shape extending along the longitudinal direction, in particular a generally rectangular shape with arched smaller sides (front and rear sides). FIG. 1B is an enlarged perspective view of the portion of the snowshoe 10 shown in dashed circle 13 in FIG. 1A.

The front and rear binding devices 14 and 16 are aligned along the longitudinal direction and are preferably positionable at an adjustable distance from each other. To this end, according to the illustrated embodiment the front binding device 14 is attached to the plate 12 in a fixed position, while the rear binding device 16 can be attached to the plate 12 in a number of positions spaced from each other, as will be explained in detail further on.

With reference now to FIGS. 2A to 4 as well, the plate 12 has a lattice-like configuration and is preferably made in one piece, for example of plastic material. FIG. 2B is an enlarged perspective view of the portion of the snowshoe 10 shown in dashed box 15 in FIG. 2A. In the embodiment proposed herein the plate 12 is essentially flat, its middle plane being indicated P in FIG. 3, but might also be slightly concave and have therefore a non-flat middle surface. According to the present invention, the plate 12 is formed by a plurality of hollow prismatic structures 18*a*, 18*b* (FIG. 2A) which are partially superimposed on one another and are inclined to the horizontal (or, in broader terms, to the middle surface of the plate, be it flat or not). In particular, the main axis (indicated x in FIG. 3) of each structure 18*a*, 18*b* is inclined to such an extent that its projection on a longitudinal vertical plane, i.e. on a vertical plane directed along the longitudinal direction, or front-to-rear direction, of the snowshoe (coinciding with the section plane of the section view of FIG. 3) forms an angle $\alpha$ comprised between 20° and 70° with the vertical direction (indicated z) or, in broader terms, with the direction normal to the middle surface of the plate. The angle $\alpha$ is preferably comprised between 30° and 50°, and more preferably between 35° and 45°.

By virtue of such an inclined arrangement of the structures 18*a*, 18*b*, the lower edges 20*a*, 20*b* of these structures form sharp edges that allow the plate 12 to get a grip on the snow, be it powder or packed snow, and therefore make walking, in particular climbing, easier. Furthermore, such an inclined arrangement of the structures 18*a*, 18*b* causes the inner surfaces (indicated 19*a*, 19*b*) of the structures to provide generally high resistance to penetration into the snow and hence to distribute the weight of the user over a wide contact surface, thereby ensuring good floatability. In other words, the inclined inner surfaces 19*a*, 19*b* of the hollow prismatic structures 18*a*, 18*b* define respective openings, or through holes, 16*a*, 16*b* in the plate 12 through which snow can come into contact with the inclined inner surfaces 19*a*, 19*b* from below when the snowshoe 10 is in use. As the snow comes into contact with the inclined inner surfaces 19*a*, 19*b*, their inclinations resist penetration of the hollow prismatic structures 18*a*, 18*b* into the snow and provide additional area on which the weight of the user is distributed to provide floatability in snow.

Figure 2A:
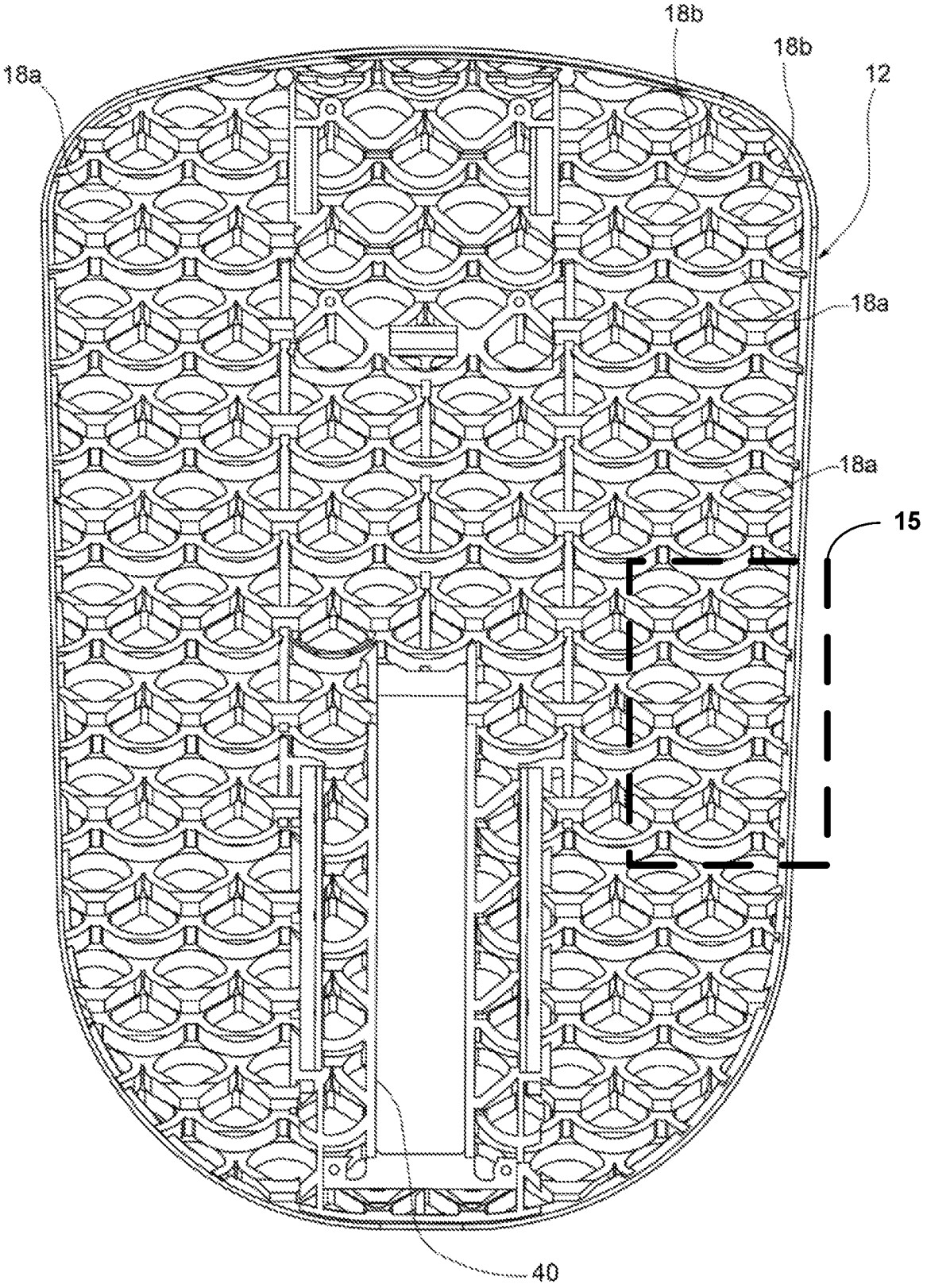
FIG. 2A is a plan view of the plate of the snowshoe of FIG. 1A.
Figure 2B:
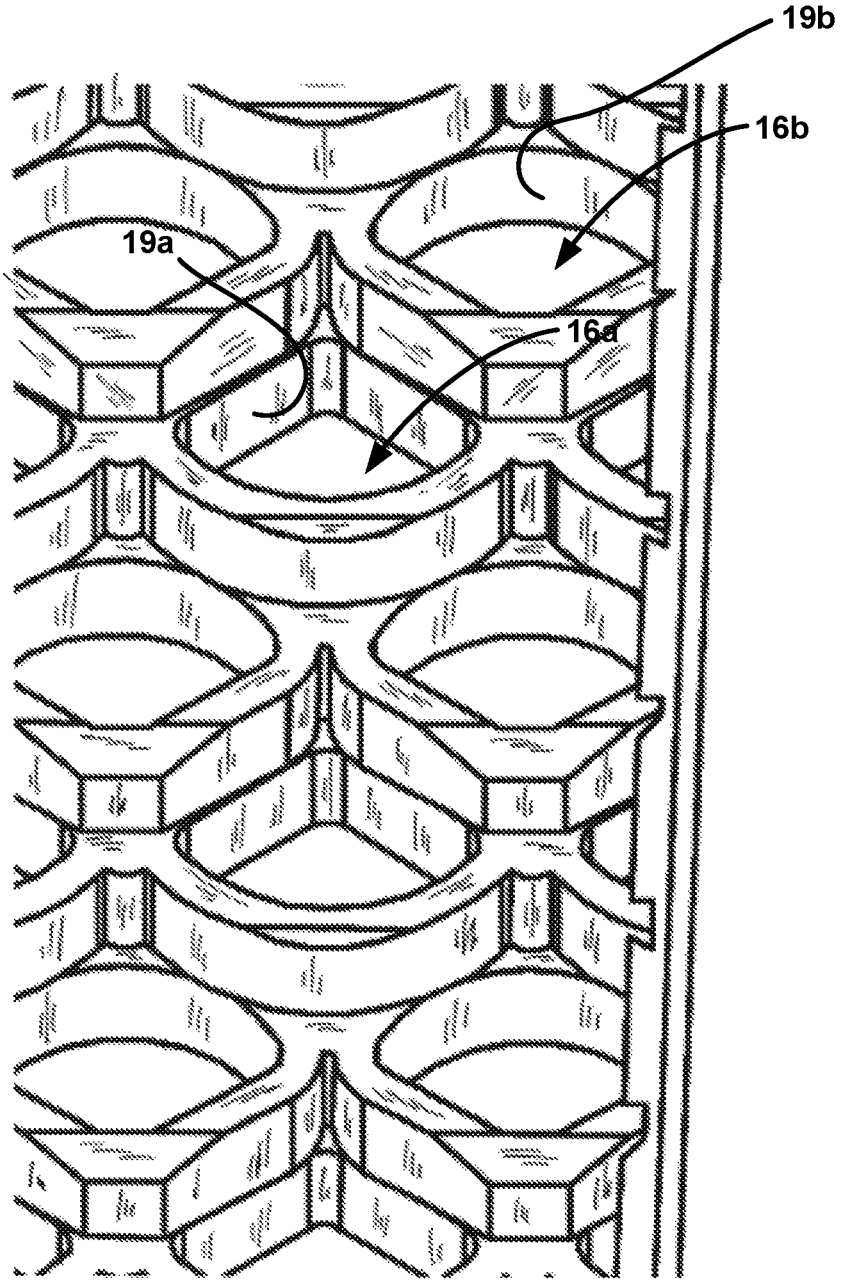
FIG. 2B is an enlarged plan view of a portion of the plate of the snowshoe of FIG. 2A.

In the enlarged top and bottom views shown in FIGS. 1B and 2B, respectively, it can be seen that the openings 16*a* and 16*b* defined by the inclined inner surfaces 19*a* and 19*b* of the hollow prismatic structures 18*a* and 18*b*, respectively, extend through the plate 12, giving the plate 12 the aforementioned lattice-like configuration.

In the embodiment shown in the drawings the main axes x of the hollow prismatic structures 18*a*, 18*b* are all oriented so as to lie in longitudinal vertical planes, but at least some of them might also be inclined relative to these planes, preferably with different angles of inclination depending on the area of the plate.

Preferably, the plate 12 comprises a first group of structures (those indicated 18*a*) having an arched lower edge 20*a*, which is particularly suitable for powder snow, and a second group of structures (those indicated 18*b*) having a cusped lower edge 20*b*, particularly suitable for packed snow. According to the illustrated embodiment, the plate 12 is configured so as to have rows of structures 18*a* of the first group, i.e. with arched lower edge 20*a*, alternate with rows of structures 18*b* of the second group, i.e. with cusped lower edge 20*b*. The invention is not however limited to the specific configuration illustrated herein, as the plate might comprise a higher number of groups of structures of different shape than the one illustrated herein and/or shapes of the structures different from those illustrated herein and/or an arrangement of the groups of structures on the surface of the plate different from the one illustrated herein. Furthermore, although in the illustrated embodiment the hollow prismatic structures have the same sizes, it is however conceivable that the hollow prismatic structures have different sizes (preferably up to 50%) in the various areas of the plate.

Figure 3:
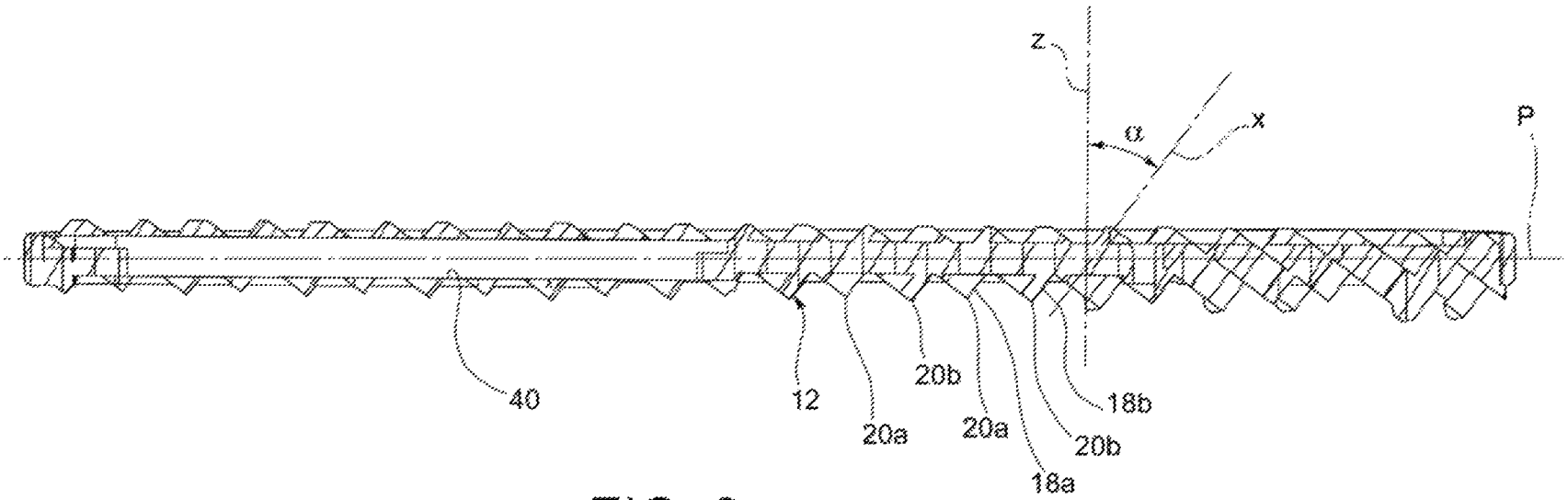
FIG. 3 is a section view of the plate of FIG. 2 through a longitudinal vertical section plane.
Figure 4:
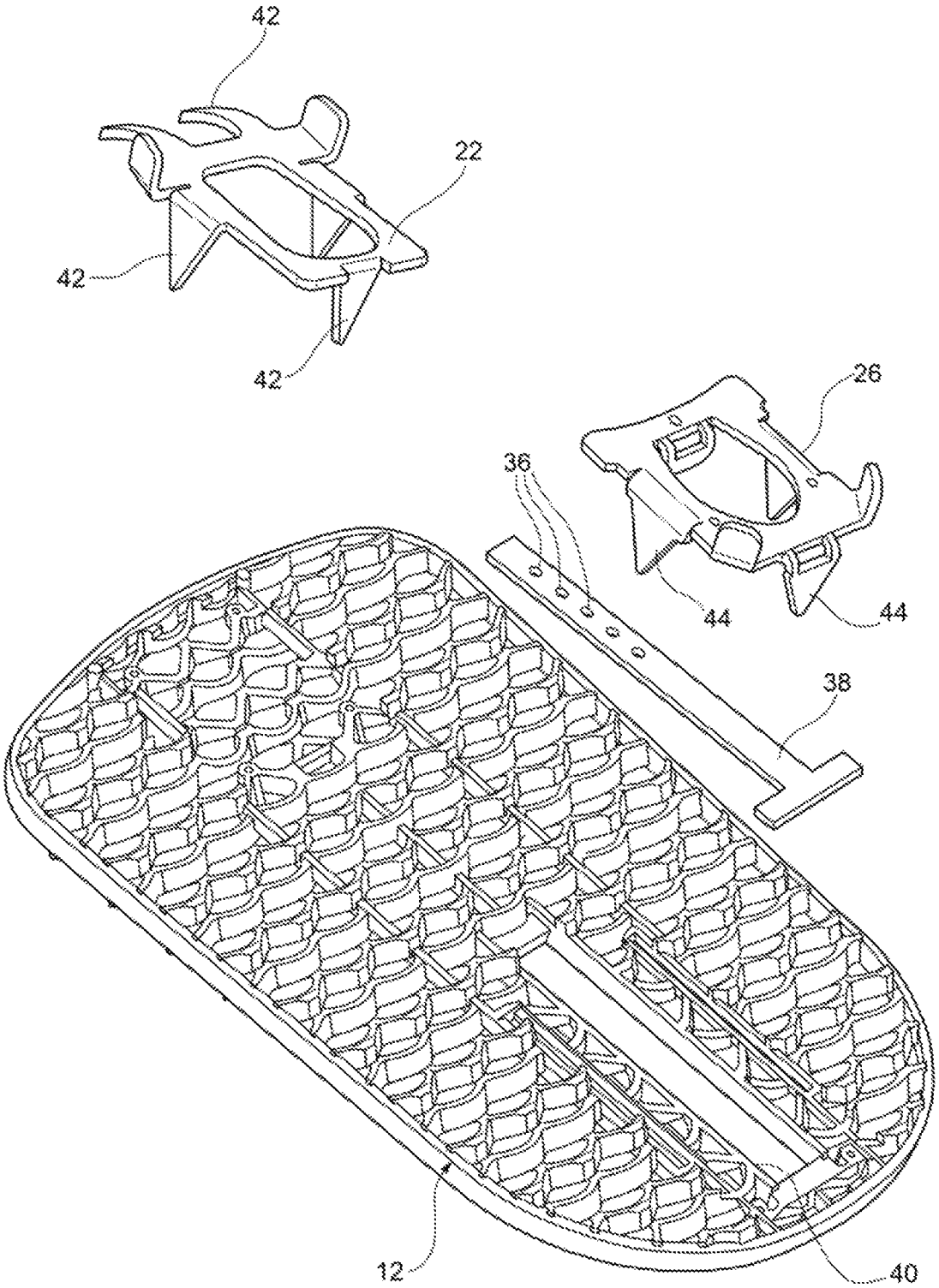
FIG. 4 is an exploded view of some components of the snowshoe of FIG. 1.

According to an embodiment (not shown), the main axes x of the structures 18*a*, 18*b* may have different inclinations in the various areas of the plate 12, in particular be inclined frontwards (like the structures 18*a*, 18*b* shown in the section view of FIG. 3) in the front part of the plate, so as to improve the grip of the snowshoe on the ground during climbing, and inclined rearwards in the rear part of the plate, so as to improve the grip of the snowshoe on the ground during descent.

The front binding device 14 comprises a base element 22, preferably of metal, which is attached to the plate 12, and a binding member 24, which is hinged to the base element 22 so as to be able to tilt relative to the latter, and hence relative to the plate 12, about a transverse axis of oscillation y and is configured to restrain the toe of the shoe. Likewise, the rear binding device 16 comprises a base element 26, preferably of metal, which is attached to the plate 12, preferably in a longitudinally adjustable position, and a binding member 28, which is attached to the base element 26 and is configured to restrain the heel of the shoe. A lace 30 is inserted into special holes or slots provided in the binding members 24 and 28 of the front and rear binding devices 14 and 16 to allow to safely fasten the snowshoe to the shoe of the user.

Adjustment of the longitudinal position of the rear binding device 16, and hence of the distance from the front binding device 14, is ensured by the possibility to engage a pin 32 of a spring member 34 (in particular a bow spring of harmonic steel) constrained to the base element 26 of the rear binding device 16 each time in one of a plurality of holes 36 provided in an insert 38, preferably also of metal like the base element 26, received in a longitudinal slot 40 of the plate 12.

The base elements 22, 24 of the front and rear binding devices 14, 16 are both preferably provided with crampons 42, 44 so as to further improve walking on ice or mixed terrain. The crampons 42, 44 may be attached to the base elements 22, 24 or be made in one piece therewith. Alternatively, the crampons 42, 44 may be attached directly to the plate 12 or be made in one piece therewith.

By virtue of the special configuration of the plate, the snowshoe according to the invention is compact and lightweight, and hence easy to manoeuvre and transport when not used, but at the same time ensures good grip on snowy, even very steep, slopes, independently of the nature of the snow, and good floatation on powder or variable snow. Moreover, by virtue of the lattice-like configuration of the plate, the snowshoe according to the invention is not easily subject to formation of snow blocks on the lower face of the plate and to accumulation of snow on the upper face upper of the same.

Naturally, the principle of the invention remaining unchanged, the embodiments and the constructional details may be greatly modified with respect to those described purely by way of non-limiting examples, without thereby departing from the scope of protection as described and claimed herein.

The invention claimed is:

1. A snowshoe comprising a footwear supporting plate configured to be detachably connected to a user's footwear, as well as a binding system attached to said plate and configured to bind the user's footwear to said plate, said plate comprising a plurality of hollow prismatic structures, wherein adjacent hollow prismatic structures partially overlap one another and wherein a main axis (x) of each of said structures is inclined with respect to a middle surface of the plate in such a manner that a projection of said main axis (x) on a longitudinal vertical plane forms an angle ($\alpha$) between 20° and 70° with a normal direction (z) perpendicular to said middle surface of the plate, wherein inclined inner surfaces of each of the hollow prismatic structures define respective openings in the plate, wherein each opening is configured to receive snow through the hollow prismatic structure, and wherein as snow comes into contact with the inclined inner surfaces, their inclinations resist penetration of the hollow prismatic structures into the snow and provide additional area on which weight of the user is distributed to provide floatability in snow.

2. The snowshoe of claim 1, wherein said angle ($\alpha$) is between 30 and 50°.

3. The snowshoe of claim 1, wherein said plurality of hollow prismatic structures comprises a first group of structures having arched lower edges and a second group of prismatic structures having pointed lower edges.

4. The snowshoe of claim 3, wherein the plate is configured so as to have rows of structures of said first group alternate with rows of structures of said second group.

5. The snowshoe of claim 1, wherein the inclined inner surfaces of the hollow prismatic structures have different inclinations with respect to the plate in various areas of the plate, in particular the inclined inner surfaces of hollow prismatic structures have a forward inclination in a front part of the plate and a backward inclination in a rear part of the plate.

6. The snowshoe of claim 1, wherein the main axes (x) of the hollow prismatic structures lie in longitudinal vertical planes.

7. The snowshoe of claim 1, wherein the main axes (x) of at least part of the hollow prismatic structures are inclined with respect to longitudinal vertical planes.

8. The snowshoe of claim 1, wherein the binding system comprises a front binding device and a rear binding device each of which is attached to the plate at an adjustable distance from each other.

9. The snowshoe of claim 1, further comprising crampons which are attached directly to the plate or are made in one piece therewith.

10. The snowshoe of claim 8, further comprising crampons which are attached to the front and rear binding devices or are made in one piece therewith.

* * * * *